US005523518A

United States Patent [19]

Shikami et al.

[11] Patent Number: 5,523,518

[45] Date of Patent: Jun. 4, 1996

[54] RECYCLING OF WASTE SULFURIC ACID

[75] Inventors: Satoshi Shikami, Kurashiki; Hitoshi Satoh, Okayama, both of Japan

[73] Assignee: Chlorine Engineers Corp., Ltd., Tokyo, Japan

[21] Appl. No.: 168,052

[22] Filed: Dec. 15, 1993

[30] Foreign Application Priority Data

Dec. 16, 1992 [JP] Japan ..... 4-335879

[51] Int. Cl.[6] ..... A62D 3/00; C25B 1/22; C25B 1/00; C02F 1/46

[52] U.S. Cl. ..... 588/204; 205/770

[58] Field of Search ..... 588/204; 204/104, 204/182.4, 149, 151

[56] References Cited

U.S. PATENT DOCUMENTS 4,613,416 9/1986 Kau et al. ..... 204/98

FOREIGN PATENT DOCUMENTS 37891 3/1976 Japan .
19171 2/1978 Japan .

OTHER PUBLICATIONS

Grant, *Hackh's Chemical Dictionary*, 4th edition, 1969, p. 484.

Skidmore, Kathy, "Reprocess Chemicals at the Fab Line" Semiconductor International, Jul. 1988, pp. 64–68.

*Primary Examiner*—John Niebling
*Assistant Examiner*—Edna Wong
*Attorney, Agent, or Firm*—Kuhn and Muller

[57] ABSTRACT

Sulfuric acid used in the process of fabricating semiconductor devices, etc., can be recycled to reduce the amount of sulfuric acid to be discarded. A sulfuric acid effluent is fed to an anode chamber of a sulfuric acid-concentrating electrolyzer partitioned by at least one cation exchange membrane to concentrate sulfuric acid and generate oxidizing substances, so that the sulfuric acid can be used at the step of using sulfuric acid, and, when the concentration of impurities built up in the system exceeds a certain level, a part of sulfuric acid in the system is fed to a unit for refining sulfuric acid, where the sulfuric acid is refined and whence the refined sulfuric acid is fed back to the system. According to this recycling process, it is possible to obtain sulfuric acid having high oxidizing power with no addition of an oxidizing substance such as hydrogen peroxide thereto.

3 Claims, 1 Drawing Sheet

RECYCLING OF WASTE SULFURIC ACID

BACKGROUND OF THE INVENTION

The present invention relates to a process for regenerating high-purity sulfuric acid having increased oxidizing power from waste sulfuric acid discharged from a surface treatment or resist stripping step involved in the process of fabricating semiconductor devices such as LSIs and VLSIs or liquid crystal display devices, and recycling it.

Sulfuric acid has a wide spectrum of applications. Sulfuric acid effluents discharged from plants, etc., have a decreased sulfuric acid content and contain salts, and so they are concentrated by water removal and cleared of salts for regeneration.

The regeneration of waste sulfuric acid is achieved by:

(1) a vacuum concentration process wherein waste sulfuric acid is heated under reduced pressure to evaporate water and the deposited salts are separated from sulfuric acid by crystallization, (2) a cooling process wherein waste sulfuric acid is cooled to crystallize out salts due to a solubility drop for sulfuric acid recovery, (3) a vacuum cooling concentration wherein waste sulfuric acid is thermally concentrated under reduced pressure and the concentrate is cooled for crystallization and separation, (4) a submerged combustion process wherein waste sulfuric acid is concentrated by submerged combustion, while salts are crystallized out for separation, thereby recovering sulfuric acid, (5) a solvent extraction process wherein salts, organic materials, etc. are extracted and removed from waste sulfuric acid using acetyl acetone, benzene, etc. as a solvent and making use of a solubility difference therebetween, (6) a pyrolysis process wherein waste sulfuric acid is decomposed into sulfur oxides in a pyrolysis furnace, and the sulfur oxides are absorbed in water or sulfuric acid for the recovery of sulfuric acid, (7) a diffusive dialysis process wherein waste sulfuric acid flows in countercurrent relation to water through an anion exchange membrane to pass sulfuric acid into water by diffusion due to a temperature difference and the selective permeation of the anion exchange membrane, thereby recovering the sulfuric acid, and (8) a two-stage distillation process wherein waste sulfuric acid is heated at a temperature not higher than 300° C. to remove a substantial part of organic matter and water, and the resulting sulfuric acid is distilled at a temperature not lower than 300° C. to separate sulfuric acid from salts and high-boiling compounds for the recovery of sulfuric acid.

With the tendency of semiconductor devices to becoming finer and having higher density, a severer restriction is now imposed on the purity of sulfuric acid for electronics industry. For instance, the sulfuric acid is required to have a metallic component content of at most 20 ppb. However, the processes (1) to (5) mentioned above are all applied to the recovery of waste sulfuric acid discharged in large amounts and on an industrial scale from viscose rayon, petroleum purification, anodized aluminum and pickling factories or plants. With these methods it is impossible to obtain high-purity sulfuric acid thanks to incomplete removal of salts. In other words, the sulfuric acid recovered by these methods have application in some fields in which sulfuric acid of high purity is not needed.

According to the diffusive dialysis process (8) it is possible to recover sulfuric acid of relatively high purity. However, the obtained sulfuric acid cannot immediately be used thanks to its low concentration. On the other hand, problems with the pyrolysis (6) and two-stage distillation (8) processes are that they are hazardous to personnel around the equipment or incurs some considerable maintenance expense due to equipment corrosion or for other reasons, because sulfuric acid is pyrolyzed, distilled or otherwise handled at high temperature.

Further, sulfuric acid for electronics industry—which is used for fabricating semiconductor devices, etc.—is mixed with a hydrogen peroxide solution for use, because it is required to increase the force with which photoresists are stripped or washed. According to the conventional processes, however, sulfuric acid is merely recovered; that is, no oxidizing substance is generated in sulfuric acid. It is thus required that fresh hydrogen peroxide solutions be supplied to the equipment during use.

The inventors have already filed a patent application for a process for recovering sulfuric acid—which is of purity high-enough to be reused at the electronics industry level, e.g., in the process of fabricating semiconductor devices—from waste sulfuric acid effluents occurring from the process of fabricating semiconductor devices such as LSIs and VLSIs. It is here noted that this patent application is now laid open for public inspection under JP-A-3-303422.

This sulfuric acid recovery process is characterized in that waste sulfuric acid is fed to a cathode chamber of a multi-chamber type electrolyzer partition by at least one anion exchange membrane and at least one cation exchange membrane into three or more chambers, said cathode chamber being formed by the anion exchange membrane and the wall of the electrolyzer, or to a cathode chamber of a two-chamber type electrolyzer partitioned by an anion exchange membrane, thereby electrolyzing the sulfuric acid in an intermediate chamber formed by the anion and cation exchange membranes or in an anode chamber of the two-chamber type electrolyzer partitioned by a cation exchange membrane, so that the sulfuric acid can be concentrated with the generation of oxidizing substances. The regenerated sulfuric acid, because of containing oxidizing substances such as peroxomonosulfuric acid, peroxodisulfuric acid and hydrogen peroxide, can be reused at the steps of stripping and washing resists with no need of adding any fresh hydrogen peroxide solution.

However, a grave problem with currently available anion exchange membranes based on fluorine or hydrocarbons is that their acid resistance is low; that is, the concentration of sulfuric acid used therewith is limited to 50% by weight at most and preferably to the range of 10 to 30% by weight. Another problem is that the selective transmission ratio of sulfuric acid ions and hydrogen ions, viz., $SO_4^{2-}/H^+$, is as low as 0.1 to 0.4 at a sulfuric acid concentration of 30 to 50% by weight.

The recovery process mentioned above makes it possible to recover sulfuric acid of purity high-enough to be used at the electronics industry level, but involves economical difficulty because of needing a number of expensive ion exchange membranes, anodes and cathodes.

Moreover, the concentration of sulfuric acid generated in the first-stage electrolyzer is limited to 30 to 50%. To concentrate this sulfuric acid and refine the oxidizing substances, previously refined sulfuric acid must be fed to the anode chamber partitioned by the second-stage ion exchange membrane. However, this must be done with a number of costly ion exchange membranes, anodes and cathodes.

One object of the present invention is to recycle sulfuric acid in a closed system by subjecting an inclusions-containing waste sulfuric acid effluent generated from the process of fabricating semiconductor devices such as LSIs and VLSIs to a relatively simple step without recourse to a number of electrolyzers and a number of ion exchange membranes, thereby recovering a sulfuric acid product containing sulfuric acid of purity high-enough to be reused in the process of fabricating semiconductor devices at the electronics industry level as well as oxidizing substances.

Another object of the present invention is to provide a process for recycling a waste sulfuric acid effluent with built-up impurities, which is discharged from a closed system in the form of discard, or for recovering a sulfuric acid product with reduced impurities.

SUMMARY OF THE INVENTION

According to the present invention, there is provided a process for recycling an inclusions-containing sulfuric acid effluent occurring from the steps of fabricating semiconductor devices in the form of an oxidizing substance-containing sulfuric acid of purity high-enough to be reused at the steps of fabricating semiconductor devices, characterized in that waste sulfuric acid is fed to an anode chamber in a sulfuric acid-concentrating electrolyzer partitioned by at least one cation exchange membrane to concentrate sulfuric acid and generate oxidizing substances, so that the sulfuric acid can be used at the step of using sulfuric acid, and, when the concentration of impurities built up in the system exceeds a certain level, a part of sulfuric acid in the system is fed to a unit for refining sulfuric acid, where it is refined and whence the refined sulfuric acid is fed back to the system.

Preferably, the unit for refining sulfuric acid is a cathode chamber of a multi-chamber type electrolyzer which is partitioned by at least one anion exchange membrane and at least one cation exchange membrane into three or more chambers, said cathode chamber being formed by the anion exchange membrane and the wall of the electrolyzer, or a cathode chamber in a two-chamber type electrolyzer partitioned by an anion exchange membrane. The sulfuric acid to be refined is fed to the unit for refining sulfuric acid for electrolysis, and the refined sulfuric acid obtained from an intermediate chamber formed by the anion and cation exchange membranes of the multi-chamber type electrolyzer or an anode chamber of the two-chamber type electrolyzer is collected and supplied into the system.

Preferably, the unit for refining sulfuric acid is a diffusive dialyzer partitioned by an anion exchange membrane, where the sulfuric effluent is refined and whence the thus refined sulfuric acid is fed back to the system.

Preferably, the sulfuric acid supplied to the sulfuric acid regenerating electrolyzer is mixed with ozone and, if required, heated and irradiated with ultraviolet rays, thereby reducing organic materials dissolved therein.

The present invention is applied to recycling an inclusions-containing sulfuric acid effluent used in the process of fabricating semiconductor devices. The process of the present invention enables the concentration level of inclusions in the recycled sulfuric acid to be analyzed and managed so that, if required, the sulfuric acid can be discharged from within the system and the discarded sulfuric acid is refined to obtain sulfuric acid of high purity, which is in turn reused to establish a closed system, whereby the sulfuric acid of high purity can be effectively used and the amount of waste sulfuric acid discharged from the acid washing step can be reduced considerably.

Thus, the present invention provides an improved process that can dispense with a number of anion exchange membranes needed for the sulfuric acid recovery process proposed by the inventors in JP-A-3-303422 and so can reduce the amount of the fresh sulfuric acid to be replenished.

DETAILED DESCRIPTION OF THE INVENTION

The concentration of impurities in sulfuric acid used in the process of semiconductor production depends on the purity of the material used for fine processing and the purity of chemicals used at the acid washing step such as sulfuric acid and hydrogen peroxide solutions. However, since the purity of these materials is very high, the incorporation of alkali metal ions—which is considered the gravest problem in the process of fabricating semiconductor devices—is negligible insofar as the materials and chemicals of high purity are used. Hence, the sulfuric acid effluent can be well reused in the process, if its sulfuric acid concentration is increased simultaneously with the regeneration of the oxidizing substances.

Waste sulfuric acid which has been used for fine processes inclusive of the process of fabricating semiconductor devices such as LSIs and VLSIs results from resist stripping and semiconductor wafer washing. Generally, impurities contained in the waste sulfuric acid contain stripped resists such as those of novolak resin, traces of alkali metals such as sodium and potassium, substances used as semiconductor device material such as gallium and arsenic, and other metals such as aluminum, iron, chromium, nickel, zinc and lead, together with residues of hydrogen peroxide added to increase the force with which resists are stripped off and washed away.

Of the impurities contained in the waste sulfuric acid, the metals are ionized for migration through the cation exchange membrane to the cathode chamber. On the other hand, suspended particles such as resist debris peeling off the resist and stemming from the carbonization of the resist do not transmit through the cation exchange membrane of the electrolyzer used for the regeneration of sulfuric acid. However, it is preferable that these particles be removed as through a precise filter film (micro filter) made of fluorocarbon resin, because they are likely to be so deposited on the cation exchange membrane that the cation exchange membrane can degrade and so must be prematurely replaced by a new one, or to promote consumption of the active substance of the anode by an oxidation reaction on the anode.

Organic materials, e.g., photosensitive agents such as Novolak resin and naphthoquinodiazides—which are main components of the constituent of a positive resist for fine processing used at the photolithographic step for semiconductor devices—are made to have low molecular weight by the oxidizing power of hydrogen peroxide in sulfuric acid used at the acid washing step. These materials, if treated over an extended period of time, is broken down into carbon dioxide, water, nitrogen, and so on. Under usual conditions for acid washing, however, these materials remain in the waste sulfuric acid in the form of low-molecular organic materials. Here, too, these dissolved organic materials are likely to have an adverse influence on the cation exchange membrane and the catalyst coating of the anode, and so are preferably subjected to complete oxidization for removal.

Removal of organic materials dissolved in a sulfuric acid-containing effluent may be achieved by various methods including the pyrolysis of that effluent. However, it is noted that the addition of some fresh liquid to the effluent is not preferable, because this brings about an increase in the amount of the effluent to be treated and a decrease in the concentration of sulfuric acid.

For removal of the organic materials dissolved in a sulfuric acid effluent, it is preferable to blow high-concentration ozone (which does not give rise to an increase in the amount of the effluent) into the effluent, if required, with the application of heat, thereby reducing the dissolved organic materials. More preferably, the effluent is irradiated with ultraviolet rays simultaneously with the introduction of ozone, thereby enhancing the action of ozone.

BRIEF DESCRIPTION OF THE DRAWING

The present invention will now be explained, more specifically but not exclusively, with reference to the accompanying single drawing.

Figure 1:
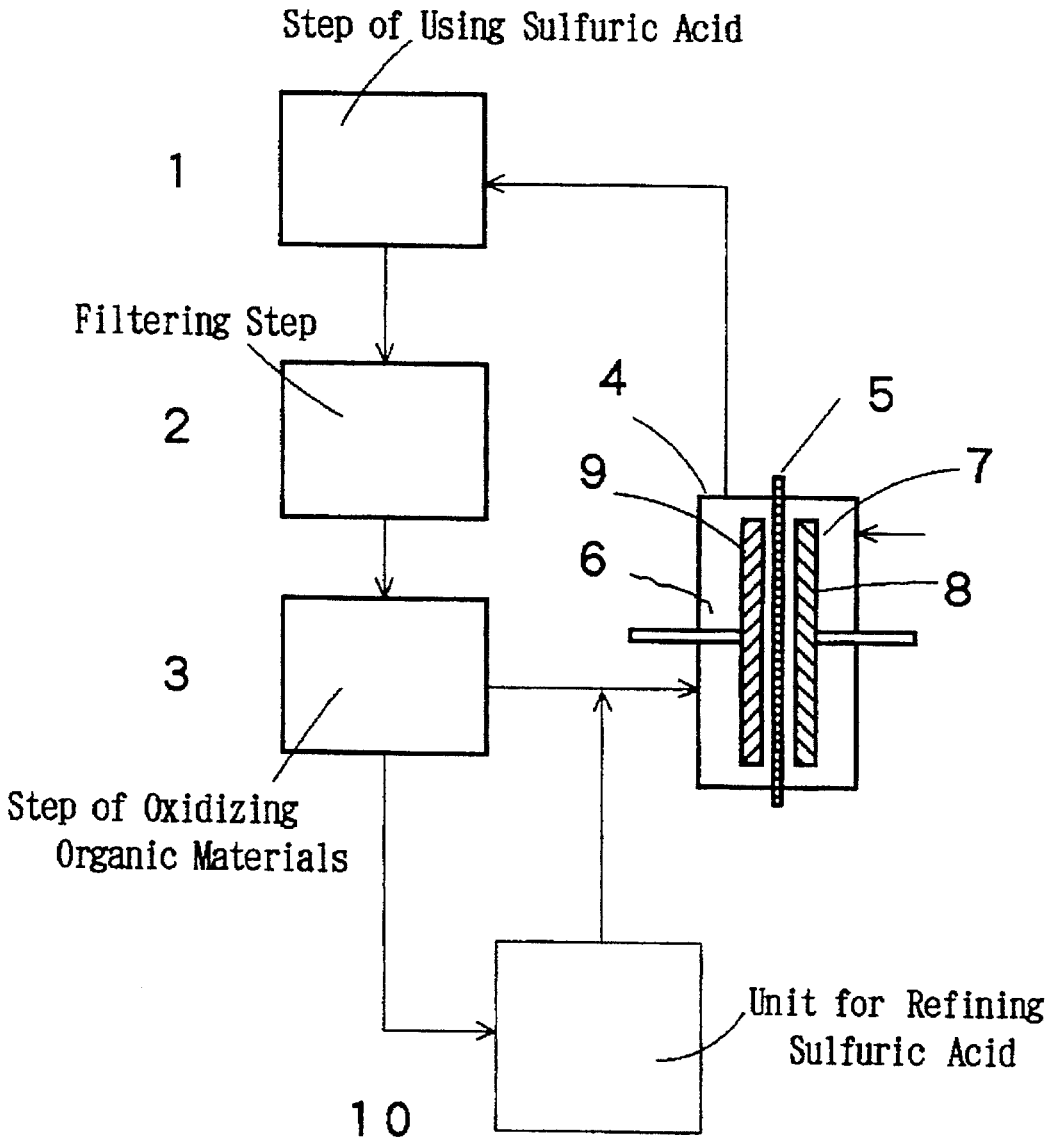
FIG. 1 is a flow chart representing the present process for recycling a sulfuric acid effluent discharged from an acid washing step, wherein sulfuric acid is regenerated from the effluent with the use of a regenerating electrolyzer and an oxidizing substances are regenerated from the effluent.

Waste sulfuric acid is supplied from a step 1 of using sulfuric acid to a filtering step 2, where solids suspended in the waste sulfuric acid, e.g., photoresist debris are filtered out through a fine filter membrane made of fluorocarbon resin.

Then, high-concentration ozone is blown into the effluent, which is in turn heated, at a step 3 of oxidizing organic materials.

The waste sulfuric acid, from which the organic residues have been removed by oxidative decomposition, is fed to a regenerating electrolyzer 4 for the concentration of sulfuric acid and the regeneration of the oxidizing substance. The regenerating electrolyzer 4 is partitioned by at least one cation exchange membrane 5 into two or more chambers. The waste sulfuric acid, from which the suspended particles and organic residues have been removed, is fed to an anode chamber 6 partitioned by the cation exchange membrane. No critical limitation is imposed on the concentration of sulfuric acid introduced into a cathode chamber 7 partitioned by the cation exchange membrane. To keep the electrolyzer voltage low, however, it is preferable to use sulfuric acid having a concentration of 30 to 50% by weight.

For the cation exchange membrane, an ion exchange membrane based on fluorocarbon resin and so excellent in corrosion resistance may be used. For instance, use may be made of an cation exchange membrane having a sulfonic acid type of ion exchange group, e.g., Naphion 324 and 417 (Du Pont).

A cathode 8 may be made up of material having increased corrosion resistance, e.g., graphite, glassy carbon, and tantalum. For an anode 9, it is preferable to use an electrode built up by coating a platinic metal or its oxide on a corrosion-resistant substrate or base such as a tantalum one which has the property of generating oxygen and is excellent in corrosion resistance. Electrolytic reactions allow hydrogen to be generated on the cathodes and oxygen and slight ozone to be generated on the anodes. It is thus preferable that the cathodes and anodes be made up of material enabling the generated gases to be rapidly released from the electrodes, e.g., expanded metal, or reticulate or porous sheets.

Hydrogen ions move from the anode chamber via the cation exchange membrane to the cathode chamber due to propelling power obtained by electrophoresis and a concentration difference. As the hydrogen ions move from the anode to the cathode chamber, there is a decrease in the amount of hydrogen ions in the anode chamber. However, there is no change in the total amount of hydrogen ions, because they are replenished by the electrolysis of water on the anodes. On the other hand, the total amount of water in the anode chamber is reduced, because some water is accompanied by hydrogen ions moving from the anode to the cathode chamber, while some water is consumed by the electrolysis of water on the anode. Consequently, the sulfuric acid in the anode chamber is concentrated.

With the electrolysis of water, oxidizing substances such as peroxomonosulfuric acid, peroxodisulfuric acid, and hydrogen peroxide are generated in the anode chamber by the anodization of sulfuric acid.

The oxidizing substance-containing sulfuric acid, which has been concentrated by electrolysis in the anode chamber of the regenerating electrolyzer, is reused at the resist stripping step or the step of washing semiconductor substrates.

When there is an increase in the concentration of impurities, the sulfuric acid is refined in a sulfuric acid refining unit 10. The thus obtained sulfuric acid of high purity is then fed back to the circulating loop of the sulfuric acid recycling step.

An aqueous solution containing sulfuric acid—which is used at the resist stripping and washing steps inclusive of the process of fabricating semiconductor devices and thereafter treated as mere discard—is introduced into the anode chamber of the electrolyzer partitioned by the cation exchange membrane for electrolysis, whereby the sulfuric acid is concentrated for recycling, with the generation of oxidizing substances. According to this process, it is possible not only to reduce the amount of the effluent which is to be finally discarded but also to feed the sulfuric acid from the anode chamber back to the resist stripping and washing steps for recycling. In addition, since oxidizing substances such as peroxomonosulfuric acid, peroxodisulfuric acid and hydrogen peroxide are contained in the sulfuric acid, it is not necessary to add any fresh oxidizing substance such as hydrogen peroxide.

EXAMPLES

The present invention will now be explained in more detail with reference to some examples.

Example 1

Step of Preparing Sulfuric Acid Effluent

Sulfuric acid for electronics industry (EL-UM, Kanto Kagaku K.K.) and hydrogen peroxide for electronics industry (EL-UM, Kanto Kagaku K.K.) were mixed together at a volume ratio of 5:1 to prepare a first sulfuric acid solution for resist stripping.

A positive type resist OFPR-800 (Tokyo Oka Kogyo K.K.) was coated on a 6-inch wafer at a thickness of 1.5 μm with the use of a spin coater to make the wafer to be treated. Twenty-five (25) such wafers were put in a vessel made of fluorocarbon resin, and 2.5 liters of the sulfuric acid obtained as mentioned above were used to strip the resists by a 1-minute heating at 140° C. Consequently, the resist could almost completely be removed from each wafer.

Concentration and Regeneration

A filter press type electrolyzer made of fluorocarbon resin and having a pair of anode and cathode, each having an effective area of 0.2 $dm^2$, was used.

The electrolyzer was partitioned by a fluorocarbon resin type of cation exchange membrane or Naphion 417 (Du Pont) into anode and cathode chambers. In the anode and cathode chambers of the electrolyzer there were provided an anode made up of a platinum coated tantalum electrode (Perumerekku Denkyoku K.K.) and a tantalum electrode, respectively.

Two point five (2.5) liters of the 90% by weight sulfuric acid effluent prepared as mentioned above were circulated through the anode chamber of the electrolyzer at a flow rate of 200 ml/min. Likewise, 2.5 liters of a 30% by weight sulfuric acid prepared by diluting sulfuric acid for electronics industry (EL-UM, Kanto Kagaku K.K.) with ultrapure water were circulated through the cathode chamber at the same flow rate. The anolyte was cooled by means of a tantalum heat exchanger. In this state, electrolysis occurred at an electrolytic temperature of 15° C. and a constant current density of 75 $A/dm^2$. After a three-hour electrolysis, persulfuric acid and hydrogen peroxide were generated in the anode chamber at the respective concentrations of 240 mM and 20 mM. The concentration of sulfuric acid was 92% in the anode chamber and 29% in the cathode chamber.

Resist Stripping by Solution Regenerated in Electrolyzer

Twenty-five (25) 6-inch wafers, each coated with a positive type resist OFPR-800 (Tokyo Oka K.K.) at a thickness of 1.5 μm were thermally treated at 140° C. for 1 minute in a fluorocarbon resin vessel, using 2.5 liters of the solution regenerated by electrolysis in the electrolyzer. Consequently, the resists could almost completely be removed from the wafers.

Example 2

Electrolytic Generation of Oxidizing Substance-Containing Sulfuric Acid for Washing Metal Contamination An electrolyzer similar to that used in Example 1 was used. While 7.5 liters of a 90% by weight sulfuric acid obtained by diluting sulfuric acid for electronics industry (EL-UM, Kanto Kagaku K.K.) with ultrapure water were circulated through the anode chamber of the electrolyzer and 7.5 liters of a 30% by weight sulfuric acid prepared by diluting sulfuric acid for electronics industry (EL-UM, Kanto Kagaku K.K.) with ultrapure water were circulated through the cathode chamber, electrolysis were done at an electrolytic temperature of 15° C. and a constant current density of 75 $A/dm^2$. After a 12-hour electrolysis, persulfuric acid and hydrogen peroxide were generated in the anode chamber at the respective concentrations of 223 mM and 28 mM. The concentration of sulfuric acid was 92% by weight in the anode chamber and 30% by weight in the cathode chamber. The solution obtained in the anode chamber of the electrolyzer was used as the sulfuric acid for washing metal contamination.

Preparation of Silicon Wafer Contaminated with Metal

Reagents for atomic absorption for metals Na, K, Ca, Sr, Al, Fe, Ni, Cu, Zn, Pb, Ba, Co and Mn were each coated on silicon wafers at a coverage of 10 μg/silicon wafer with the use of a spin coater, and then dried to obtain metal-contaminated silicon wafers.

Washing of Metal-Contaminated Silicon Wafers by Persulfuric Acid for Washing Metal Contamination Seven point five (7.5) liters of the persulfuric acid for washing metal contamination, prepared by electrolysis in the anode chamber of the electrolyzer, were divided into three equal portions (2.5 liters), which were then put in separate fluorocarbon resin vessels. One hundred (100) silicon wafers contaminated with Na, K, Ca, Sr, Al, Fe, Ni, Cu, Zn, Pb, Ba, Co and Mn, as mentioned above, were successively heat-treated at 140° C. for 1 minute in the three fluorocarbon resin vessels. Consequently, the metals could almost completely be removed from the silicon wafers. The post-treatment solution was used as the waste sulfuric acid for washing metal contamination.

Refinement of Sulfuric Acid Effluent by Diffusive Dialysis

Twenty-five (25) 6-inch wafers, each coated with a positive type resist OFPR-800 (Tokyo Oka K.K.) at a thickness of 1.5 μm, were heat-treated at 140° C. for 1 minute, using the sulfuric acid for resist stripping prepared by electrolysis, thereby removing the resists from the wafers. Then, the sulfuric acid was regenerated in the regenerating electrolyzer. This process was repeated ten times. Then, 2.5 liters of the treating solution were mixed with 7.5 liters of the sulfuric acid for washing metal contamination, thereby obtaining a mixture of the sulfuric acid effluent for resist stripping with the waste sulfuric acid for washing metal contamination. While kept at a concentration of 80% by the addition of ultrapure water for the decomposition of persulfuric acids and hydrogen peroxide, this mixture was subjected to diffusive dialysis in countercurrent relation to ultrapure water, using a diffusive dialyzer built up of a filter-pressed arrangement comprising 50 anion exchange membranes (Asahi Glass Co., Ltd.), each having an effective area of 2.5 $dm^2$, thereby recovering a 70% by weight sulfuric acid.

The quality of the obtained sulfuric acid was as follows. Na: 8 ppb, K: 4 ppb, Ca: 10 ppb, Sr: 2.7 ppb, Al: 4 ppb, Fe: 14 ppb, Ni: 4 ppb, Cu: 3.3 ppb, Zn: 5.3 ppb, Pb: 4 ppb, Ba: 3 ppb, Co: 5 ppb, Mn: 10 ppb, and insoluble particles (0.5 μm or more): 30 or less.

The quality of this solution was nearly equivalent to sulfuric acid for electronics industry.

The process according to the present invention made it possible to repeat the steps of regenerating waste sulfuric acid, generating oxidizing substances, stripping silicon wafers of resists by the regenerated sulfuric acid and washing the resists by the regenerated sulfuric acid, and refining a sulfuric acid effluent by diffusive dialysis.

Example 3

Refinement of Waste Sulfuric Acid by Electrolyzer

For the electrolyzer, a filter press type electrolyzer made of fluorocarbon resin and having a pair of anode and cathode, each having an effective area of 0.2 $dm^2$ was used.

The electrolyzer was partitioned by a fluorocarbon resin type of anion exchange membrane (DF34, Toso K.K.) into anode and cathode chambers. In the anode and cathode chambers there were provided a platinum-coated tantalum electrode (Perumerekku Denkyoku K.K.) and a tantalum electrode, respectively.

A mixture of the sulfuric acids obtained in Examples 1 and 2 and contaminated with resists and metals was fed to the cathode chamber in an amount of 10 liters, and 2.5 liters of a 10% by weight sulfuric acid obtained by diluting sulfuric acid for electronics industry (EL-UM, Kanto Kagaku K.K.) with ultrapure water were supplied to the anode chamber. Electrolysis was carried out at a constant current density of 75 A/dm2, while each solution was circulated through the electrode chamber at a flow rate of 200 ml/min. After a 24-hour electrolysis, 3 liters of a 45% by weight sulfuric acid were obtained in the anode chamber.

Analysis of the obtained sulfuric acid indicated that it contains: Na: 4 ppb, K: 2 ppb, Ca: 5 ppb, Sr: 3 ppb, Al: 4 ppb, Fe: 10 ppb, Ni: 5 ppb, Cu: 2 ppb, Zn: 5 ppb, Pb: 4 ppb, Ba: 3 ppb, Co: 5 ppb, Mn: 10 ppb, and insoluble particles (0.5 μm or more): 30 or less, and that it is nearly equivalent to sulfuric acid for electronics industry.

Example 4

Upon resist stripping repeated with the sulfuric acid underwent repeated concentration and regeneration, the sulfuric acid was tinged with brown. However, electrolysis was continued while a gas containing 80,000 ppm of ozone was blown in the anolyte of the electrolyzer. Consequently, the sulfuric acid was decolored with no absorbency change due to coloration at 300 to 700 nm.

Even after some combinations of the processes mentioned in Examples 1–4 were repeatedly used ten times, the quality of sulfuric acid was kept intact. Even when the sulfuric acid is overall replaced by a fresh one after repeatedly used ten times, a 90% saving can be achieved in terms of the amount of sulfuric acid to be used, when comparing with the case where the sulfuric acid is replaced by a fresh one whenever used. In other words, the process according to the present invention enables the step of using sulfuric acid to be established in the form of a closed system.

The present invention enables the sulfuric acid used at the steps of stripping and washing resists inclusive of the process of fabricating semiconductor devices to be recycled by concentrating the sulfuric acid in an electrolyzer including a cation exchange membrane and generating oxidizing substances. In addition, the sulfuric acid having an increased concentration of impurities is fed from within the system to a unit for refining sulfuric acid, where it is refined. The thus refined sulfuric acid is fed back to the system for reuse, whereby the rate of recycling sulfuric acid in the system can be improved; that is, the amount of sulfuric acid to be discarded can be reduced.

What is claimed is:

1. A process for regenerating a sulfuric acid treating solution for use in a process for fabrication of semiconductor devices which comprises feeding a waste sulfuric acid solution from a semiconductor fabrication system to an anode chamber of a sulfuric acid concentrating electrolyzer partitioned by at least one cation exchange membrane into at least two chambers wherein sulfuric acid concentration in said solution is increased while generating at least one oxidizing agent in an amount sufficiently to effectively treat semiconductor devices and recycling said treated sulfuric acid solution to said semiconductor fabrication system, wherein said waste sulfuric acid solution from a process for fabrication of semiconductor devices containing an undesirable concentrate of impurities is fed to a sulfuric acid refining unit, said unit for refining sulfuric acid is a cathode chamber of a multi-chamber type electrolyzer which is partitioned by at least one anion exchange membrane and at least one cation exchange membrane into three or more chambers, said cathode chamber being formed by the anion exchange membrane and the wall of the electrolyzer, or a cathode chamber of a two-chamber type electrolyzer partitioned by an anion exchange membrane, the sulfuric acid to be refined being fed to the unit for refining sulfuric acid for electrolysis, and the refined sulfuric acid obtained from an intermediate chamber formed by the anion and cation exchange membranes of the multi-chamber type electrolyzer or an anode chamber of the two-chamber electrolyzer being collected and recycled into the system, wherein the unit for refining sulfuric acid is a diffusive dialyzer partitioned by an anion exchange membrane where the waste sulfuric acid is refined and whence the refined sulfuric acid is fed back to the system.

2. A process for regenerating a sulfuric acid treating solution for use in a process for fabrication of semiconductor devices which comprises feeding a waste sulfuric acid solution from a semiconductor fabrication system to an anode chamber of a sulfuric acid concentrating electrolyzer partitioned by at least one cation exchange membrane into at least two chambers wherein sulfuric acid concentration in said solution is increased while generating at least one oxidizing agent in an amount sufficiently to effectively treat semiconductor devices and recycling said treated sulfuric acid solution to said semiconductor fabrication system, wherein said waste sulfuric acid solution from a process for fabrication of semiconductor devices containing an undesirable concentrate of impurities is fed to a sulfuric acid refining unit, said unit for refining sulfuric acid is a cathode chamber of a multi-chamber type electrolyzer which is partitioned by at least one anion exchange membrane and at least one cation exchange membrane into three or more chambers, said cathode chamber being formed by the anion exchange membrane and the wall of the electrolyzer, or a cathode chamber of a two-chamber type elecrolyzer partitioned by an anion exchange membrane, the sulfuric acid to be refined being fed to the unit for refining sulfuric acid for electrolysis, and the refined sulfuric acid obtained from an intermediate chamber formed by the anion and cation exchange membranes of the multi-chamber type electrolyzer or an anode chamber of the two-chamber electrolyzer being collected and recycled into the system, wherein the sulfuric acid supplied to a sulfuric acid regenerating electrolyzer is mixed with ozone, thereby reducing organic materials dissolved therein.

3. A process for regenerating a sulfuric acid treating solution for use in a process for fabrication of semiconductor devices which comprises a feeding a waste sulfuric acid solution from a semiconductor fabrication system to an anode chamber of a sulfuric acid concentrating electrolyzer partitioned by at least one cation exchange membrane into at least two chambers wherein sulfuric acid concentration in said solution is increased while generating at least one oxidizing agent in an amount sufficiently to effectively treat semiconductor devices and recycling said treated sulfuric acid solution to said semiconductor fabrication system, wherein said at least one oxidizing agent generating in the anode chamber is at least one compound selected from the group consisting of peroxomonosulfuric acid, peroxodisulfuric acid and hydrogen peroxide.

* * * * *